US008324789B2

(12) United States Patent
Hisayasu et al.

(10) Patent No.: US 8,324,789 B2
(45) Date of Patent: Dec. 4, 2012

(54) SELF-BALLASTED LAMP AND LIGHTING EQUIPMENT

(75) Inventors: Takeshi Hisayasu, Yokosuka (JP); Kazuto Morikawa, Yokosuka (JP); Yusuke Shibahara, Yokosuka (JP); Makoto Sakai, Yokosuka (JP); Tomohiro Sanpei, Yokosuka (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 88 days.

(21) Appl. No.: 12/886,025

(22) Filed: Sep. 20, 2010

(65) Prior Publication Data

US 2011/0074269 A1 Mar. 31, 2011

(30) Foreign Application Priority Data

Sep. 25, 2009 (JP) ..... 2009-221638
Sep. 30, 2009 (JP) ..... 2009-227474

(51) Int. Cl.
*H01J 1/02* (2006.01)

(52) U.S. Cl. ..... 313/46; 362/555; 362/800

(58) Field of Classification Search ..... 313/45–46; 362/555, 800, 249.02, 249.03, 249.04, 249.05, 362/249.06, 294, 547
See application file for complete search history.

(56) References Cited

U.S. PATENT DOCUMENTS

| | | | |
|---|---|---|---|
| 1,972,790 | A | 9/1934 | Olley |
| 4,355,853 | A | 10/1982 | Kourimsky |
| 4,503,360 | A | 3/1985 | Bedel |
| 4,630,182 | A | 12/1986 | Moroi |
| 4,939,420 | A | 7/1990 | Lim |
| 5,327,332 | A | 7/1994 | Hafemeister |
| D356,107 | S | 3/1995 | Watanabe et al. |
| 5,537,301 | A | 7/1996 | Martich |
| 5,556,584 | A | 9/1996 | Yamazaki |
| 5,585,697 | A | 12/1996 | Cote |
| 5,632,551 | A | 5/1997 | Roney |
| 5,775,792 | A | 7/1998 | Wiese |
| 5,785,418 | A | 7/1998 | Hochstein |
| 5,857,767 | A | 1/1999 | Hochstein |

(Continued)

FOREIGN PATENT DOCUMENTS

CN 101307887 11/2008

(Continued)

OTHER PUBLICATIONS

Extended European Search Report issued in EP 111560003.9 on May 18, 2011. Extended European Search Report issued in EP 08838942.4 on Jun. 1, 2011.
English Language Abstract of JP 2008-277561 published on Nov. 13, 2008.
English Language Translation of JP 2008-277561 published on Nov. 13, 2008.
English Language Abstract of JP 2008-227412 published Sep. 25, 2008.
English Language Translation of JP 2008-227412 published Sep. 25, 2008.
Japanese Office Action issued in 2005-269017 on Jan. 13, 2011.
English Language Translation of Japanese Office Action issued in 2005-269017 on Jan. 13, 2011.

(Continued)

*Primary Examiner* — Anne Hines
(74) *Attorney, Agent, or Firm* — DLA Piper LLP (US)

(57) ABSTRACT

A base body having a base body portion and a plurality of heat radiating fins disposed on the circumference of the base body portion is provided. On one end side of the base body, a light-emitting module having semiconductor light-emitting elements, and a globe that covers the light-emitting module are provided. A cap is provided on the other end side of the base boy. A lighting circuit is housed between the base body and the cap. The lamp total length from the globe to the cap is 70 to 120 mm, and the area of a surface of the base body which is exposed to the outside per 1 W of power charged to the light-emitting module is 20.5 to 24.4 $cm^2/W$.

10 Claims, 6 Drawing Sheets

U.S. PATENT DOCUMENTS 5,947,588 A 9/1999 Huang
6,095,668 A 8/2000 Rykowski et al.
6,161,910 A 12/2000 Reisenauer
6,186,646 B1 2/2001 Wiedemer
6,227,679 B1 5/2001 Zhang et al.
6,234,649 B1 5/2001 Katougi
6,294,973 B1 9/2001 Kimura
6,502,968 B1 1/2003 Simon
6,517,217 B1 2/2003 Liao
6,525,668 B1 2/2003 Petrick
6,598,996 B1 7/2003 Lodhie
6,641,283 B1 11/2003 Bohler
6,787,999 B2 9/2004 Stimac et al.
D497,439 S 10/2004 Shaw et al.
6,814,470 B2 11/2004 Rizkin et al.
6,936,855 B1 8/2005 Harrah
6,948,829 B2 9/2005 Verdes et al.
6,982,518 B2 1/2006 Chou et al.
7,059,748 B2 6/2006 Coushaine
7,074,104 B2 7/2006 Itaya
7,111,961 B2 9/2006 Trenchard
7,125,146 B2 10/2006 Willis
7,144,140 B2 12/2006 Sun et al.
D534,665 S 1/2007 Egawa et al.
D535,038 S 1/2007 Egawa et al.
7,165,866 B2 1/2007 Li
7,198,387 B1 4/2007 Gloisten et al.
7,226,189 B2 6/2007 Lee et al.
7,281,818 B2 10/2007 You
7,300,173 B2 11/2007 Catalano
7,329,024 B2 2/2008 Lynch
7,331,689 B2 2/2008 Chen
7,347,589 B2 3/2008 Ge
7,431,477 B2 10/2008 Chou et al.
7,497,596 B2 3/2009 Ge
7,631,987 B2 12/2009 Wei
7,679,096 B1 3/2010 Ruffin
7,758,223 B2 7/2010 Osawa et al.
7,824,075 B2 11/2010 Maxik
7,919,339 B2 4/2011 Hsu
7,947,596 B2 5/2011 Takeda
7,963,686 B2 6/2011 Hu
8,058,784 B2 11/2011 Treurniet
8,066,417 B2 11/2011 Balazs
2002/0012246 A1 1/2002 Rincover et al.
2002/0024814 A1 2/2002 Matsuba
2002/0195918 A1 12/2002 Matsuba et al.
2003/0063476 A1 4/2003 English et al.
2003/0117797 A1 6/2003 Sommers et al.
2003/0117801 A1 6/2003 Lin
2003/0137838 A1 7/2003 Rizkin et al.
2003/0151917 A1 8/2003 Daughtry
2004/0012955 A1 1/2004 Hsieh
2004/0109310 A1 6/2004 Galli
2004/0120156 A1 6/2004 Ryan
2004/0145898 A1 7/2004 Ase et al.
2004/0156191 A1 8/2004 Biasoli
2004/0218385 A1 11/2004 Tomiyoshi
2004/0232815 A1 11/2004 Tomiyoshi et al.
2005/0007772 A1 1/2005 Yen
2005/0024864 A1 2/2005 Galli
2005/0068776 A1 3/2005 Ge
2005/0073244 A1 4/2005 Chou et al.
2005/0111234 A1 5/2005 Martin et al.
2005/0162864 A1 7/2005 Verdes et al.
2005/0174769 A1 8/2005 Yong
2005/0243552 A1 11/2005 Maxik
2005/0254246 A1 11/2005 Huang
2006/0043546 A1 3/2006 Kraus
2006/0092640 A1 5/2006 Li
2006/0193130 A1 8/2006 Ishibashi
2006/0193139 A1 8/2006 Sun
2006/0198147 A1 9/2006 Ge
2006/0215408 A1 9/2006 Lee
2006/0227558 A1 10/2006 Osawa
2006/0239002 A1 10/2006 Chou et al.
2007/0002570 A1 1/2007 Souza
2007/0041182 A1 2/2007 Ge et al.
2007/0096114 A1 5/2007 Aoki
2007/0103904 A1 5/2007 Chen
2007/0279903 A1 12/2007 Negley
2008/0002100 A1 1/2008 Kaneko
2008/0037255 A1 2/2008 Wang
2008/0084701 A1 4/2008 Van De Ven
2008/0112170 A1 5/2008 Trott
2008/0130298 A1 6/2008 Negley
2008/0173883 A1 7/2008 Hussell
2008/0289867 A1 11/2008 Owens
2009/0059595 A1 3/2009 Ge
2009/0116229 A1 5/2009 Dalton
2009/0116231 A1 5/2009 Miller
2009/0175041 A1 7/2009 Yuen et al.
2009/0184616 A1 7/2009 Van De Ven
2009/0184646 A1 7/2009 Devaney
2009/0207602 A1 8/2009 Reed
2009/0294780 A1 12/2009 Chou
2010/0026157 A1 2/2010 Tanaka
2010/0060130 A1 3/2010 Li
2010/0067241 A1 3/2010 Lapatovich
2010/0096992 A1 4/2010 Yamamoto
2010/0207534 A1 8/2010 Dowling
2010/0219735 A1 9/2010 Sakai et al.
2010/0225220 A1 9/2010 Tanaka et al.
2010/0237761 A1 9/2010 Osawa et al.
2010/0237779 A1 9/2010 Osawa et al.
2010/0244650 A1 9/2010 Osawa et al.
2010/0244694 A1 9/2010 Osawa et al.
2010/0253200 A1 10/2010 Osawa et al.
2010/0277082 A1* 11/2010 Reed et al. ..... 315/159
2010/0289393 A1 11/2010 Cantrell et al.
2010/0289396 A1 11/2010 Osawa
2010/0315442 A1 12/2010 Pauritsch
2010/0327746 A1 12/2010 Hisayasu
2010/0327751 A1 12/2010 Takenaka et al.
2011/0025206 A1 2/2011 Hiramatsu et al.
2011/0063842 A1 3/2011 Takei et al.
2011/0068674 A1 3/2011 Takenaka et al.
2011/0074269 A1 3/2011 Hisayasu et al.
2011/0074271 A1 3/2011 Takeshi et al.
2011/0074290 A1 3/2011 Sakai et al.
2011/0074291 A1 3/2011 Osawa et al.
2011/0089806 A1 4/2011 Suwa et al.
2011/0156569 A1 6/2011 Osawa

FOREIGN PATENT DOCUMENTS

DE 10 2004 042186 3/2006
DE 20 2008 016 231 4/2009
EP 1705421 9/2006
EP 2037633 3/2009
EP 2149742 2/2010
EP 2 163 808 3/2010
JP 57-152706 9/1982
JP 59-035303 2/1984
JP 61-35216 2/1986
JP 62-190366 12/1987
JP 63-5581 1/1988
JP 63-102265 5/1988
JP 64-7204 1/1989
JP 1-206505 8/1989
JP 2-91105 3/1990
JP 2000-083343 3/2000
JP 2000-173303 6/2000
JP 2001-243809 9/2001
JP 2002-525814 8/2002
JP 2002-280617 9/2002
JP 2003-016808 1/2003
JP 2003-059305 2/2003
JP 2003-59330 2/2003
JP 2003-92022 3/2003
JP 2004-6096 1/2004
JP 2004-119078 4/2004
JP 2004-193053 7/2004
JP 2004-6096 8/2004
JP 2004-221042 8/2004
JP 2005-93097 4/2005
JP 2005-123200 5/2005
JP 2005-513815 5/2005

| | | |
|---|---|---|
| JP | 2005-166578 | 6/2005 |
| JP | 2005-286267 | 10/2005 |
| JP | 2006-040727 | 2/2006 |
| JP | 3121916 | 5/2006 |
| JP | 2006-156187 | 6/2006 |
| JP | 2006-244725 | 9/2006 |
| JP | 2006-310057 | 11/2006 |
| JP | 2006-313717 | 11/2006 |
| JP | 2006-313718 | 11/2006 |
| JP | 2007-073306 | 3/2007 |
| JP | 2007-188832 | 7/2007 |
| JP | 2007-207576 | 8/2007 |
| JP | 2008-027910 | 2/2008 |
| JP | 2008-91140 | 4/2008 |
| JP | 2008-227412 | 9/2008 |
| JP | 2008-277561 | 11/2008 |
| JP | 2009-037995 | 2/2009 |
| JP | 2009-37995 | 2/2009 |
| JP | 2009-117342 | 5/2009 |
| JP | 2009-135026 | 6/2009 |
| JP | 2009-206104 | 8/2009 |
| WO | WO 03/056636 | 7/2003 |
| WO | WO 2005/024898 | 3/2005 |
| WO | WO 2006/118457 | 11/2006 |
| WO | WO 2008/146694 | 12/2008 |
| WO | WO 2009/087897 | 7/2009 |

OTHER PUBLICATIONS

English Language Abstract of JP 2004-221042 published Aug. 5, 2004.
English Language Translation of JP 2004-221042 published Aug. 5, 2004.
English Language Abstract of JP 63-102265 published May 7, 1988.
English Language Abstract of JP 2009-206104 published Sep. 10, 2009.
English Language Translation of JP 2009-206104 published Sep. 10, 2009.
European Search Report issued in EP 10178361.1 on Jul. 4, 2011.
U.S. Appl. No. 13/172,557.
U.S. Appl. No. 13/221,519.
U.S. Appl. No. 13/221,551.
U.S. Appl. No. 12/794,379.
U.S. Appl. No. 12/794,429.
U.S. Appl. No. 12/794,476.
U.S. Appl. No. 12/738,081.
U.S. Appl. No. 12/885,005.
English Language Abstract of JP 2001-243809, published Sep. 7, 2001.
English Language Abstract of JP Publication 01-206505 published Aug. 18, 1989.
English Language Abstract of JP Publication 2005-093097 published Apr. 7, 2005.
English Language Abstract of JP Publication 2005-123200 published May 12, 2005.
English Language Abstract of JP 2006-313718, published Nov. 16, 2006.
English Language Abstract of JP Publication 63-005581 published Jan. 11, 1988.
English Language Abstract of JP Publication 64-007402 published Jan. 11, 1989.
English Language Machine Translation of JP 2000-083343, published Mar. 21, 2000.
English Language Machine Translation of JP 2000-173303 published Jun. 23, 2000.
English Language Machine Translation of JP 2001-243809, published Sep. 7, 2001.
English Language Machine translation of JP 2003-59330 published Feb. 28, 2003.
English Language Machine Translation of JP 2004-006096 published Jan. 8, 2004.
English Language Machine Translation of JP 2004-193053 published Jul. 8, 2004.
English Language Machine Translation of JP 2005-166578 published Jun. 23, 2005.
English Language Machine translation of JP 2005-513815 published May 12, 2005.
English Language Machine translation of JP 2006-040727 published Feb. 9, 2006.
English Language Machine Translation of JP 2006-310057, published Nov. 9, 2006.
English Language Machine Translation of JP 2006-313718, published Nov. 16, 2006.
English Language Machine translation of JP 2008-91140 published Apr. 17, 2008.
English Language Machine Translation of JP 2009-37995, published Feb. 19, 2009.
English Language Machine Translation of JP 3121916, published May 10, 2006.
English Language Machine Translation of JP Publication 2005-093097 published Apr. 7, 2005.
English Language Machine Translation of JP Publication 2005-123200.
English Language Machine translation of JP-2002-280617published Sep. 27, 2002.
English Language Machine translation of JP-2005-286267 published Oct. 13, 2005.
English Language Machine translation of JP-2006-244725 published Sep. 14, 2006.
English Language Machine Translation ofJP 2003-092022 published Mar. 28, 2003.
English Language Translation of Office Action issued in corresponding Japanese Appl 2005-221571 on Oct. 20, 2009.
English Language Translation of International Search Report for PCT/JP2008/073436 mailed Mar. 24, 2009.
English translation of Office Action issued in corresponding Japanese Appl 2005-221571 on Jul. 7, 2009.
English translation of Office Action issued in corresponding Japanese Appl 2005-221571 on Aug. 25, 2009.
English Language Translation of Office Action issued in Japanese Appl 2005-221688 on Jan. 26, 2010.
Machine English language translation of JP-2003-016808 published Jan. 17, 2003.
Office Action issued in corresponding Japanese Appl 2005-221571 on Jul. 7, 2009.
Office Action issued in corresponding Japanese Appl 2005-221571 on Aug. 25, 2009.
Office Action issued in corresponding Japanese Appl 2005-221571 on Oct. 20, 2009.
Search Report of International Application No. PCT/JP2008/068625 mailed Dec. 9, 2008.
English Language Abstract of JP 2004-193053 published Jul. 8, 2004.
English Language Abstract of JP 2-91105 published Mar. 30, 1990.
English Language Abstract of JP 2000-173303 published Jun. 23, 2000.
English Language Abstract of JP 2003-092022 published Mar. 28, 2003.
English language abstract of JP-2002-280617 published Sep. 27, 2002.
English language abstract of JP-2003-016808 published Jan. 17, 2003.
English Language Abstract of 2003-59330 published Feb. 28, 2003.
English Language Abstract of JP 2005-166578 published Jun. 23, 2005.
English language abstract of JP-2005-286267 published Oct. 13, 2005.
English Language Abstract of JP 2006-040727 published Feb. 9, 2006.
English language abstract of JP-2006-244725 published Sep. 14, 2006.
English Language Abstract of JP 2008-91140 published Apr. 17, 2008.
Enolish Language Abstract of JP 2004-006096 published Jan. 8, 2004.
Office Action issued in Japanese Appl 2005-221688 on Jan. 26, 2010.
Enalish Language Abstract of JP 2009-37995, published Feb. 19, 2009.

English Language Abstract of JP 2000-083343, published Mar. 21, 2000.
English Language Abstract of JP 57-152706 published Sep. 21, 1982.
English Language Abstract of JP 2006-310057, published Nov. 9, 2006.
International Preliminary Report on Patentability and Written Opinion issued in PCT/JP2008/068625 mailed May 11, 2010.
Office Action issued in Japanese Appl 2005-371406 on Apr. 20, 2010.
English Translation of Office Action issued in Japanese Appl 2005-371406 on Apr. 20, 2010.
U.S. Appl. No. 12/825,650.
U.S. Appl. No. 12/794,509.
U.S. Appl. No. 12/794,558.
U.S. Appl. No. 12/811,795.
U.S. Appl. No. 12/713,230.
U.S. Appl. No. 12/825,956.
Japanese Office Action issued in JP 2008-198625 on May 26, 2010.
English Translation of Japanese Office Action issued in JP 2008-198625 on May 26, 2010.
Amendment filed in JP 2008-198625 on Jun. 28, 2010.
English Translation of Amendment filed in JP 2008-198625 on Jun. 28, 2010.
English Language Abstract of JP 2006-313717 published Nov. 16, 2006.
Machine English Translation of JP 2006-313717 published Nov. 16, 2006.
English Language Abstract of JP 2009-135026 published Jun. 18, 2009.
English Language Translation of JP 2009-135026 published Jun. 18, 2009.
English Language Abstract of JP 2002-525814 published Aug. 13, 2002.
English Language Abstract of JP 2003-059305 published Feb. 28, 2003.
English Language Translation of JP 2003-059305 published Feb. 28, 2003.
English Language Abstract of JP 2009-037995 published Feb. 19, 2009.
English Language Translation of JP 2009-037995 published Feb. 19, 2009.
English Language Abstract of JP 2007-188832 published Jul. 26, 2007.
English Language Translation of JP 2007-188832 published Jul. 26, 2007.
English Language Abstract of JP 2008-027910 published Feb. 7, 2008.
English Language Translation of JP 2008-027910 published Feb. 7, 2010.
English Language Abstract of JP 2007-207576 published Aug. 16, 2007.
English Language Translation of JP 2007-207576 published Aug. 16, 2007.
English Language Abstract of JP 2007-073306 published Mar. 22, 2007.
English Language Translation of JP 2007-073306 published Mar. 22, 2007.
U.S. Appl. No. 12/880,490.
U.S. Appl. No. 12/845,330.
U.S. Appl. No. 12/933,969.
U.S. Appl. No. 12/885,849.
U.S. Appl. No. 12/886,025.
U.S. Appl. No. 12/886,123.
U.S. Appl. No. 11/399,492 (now U.S. Patent 7,758,223).
Extended European Search Report issued in EP Appl 10006720.6 on Oct. 13, 2010.
English Language Abstract of JP 61-35216 published Feb. 2, 1086.
IPRP & WO issued in PCT/JP2008/073436 on Aug. 10, 2010.
U.S. Appl. No. 13/034,959, filed Feb. 25, 2011, Pending.
U.S. Appl. No. 13/172,557, filed Jun. 29, 2011, Pending.
U.S. Appl. No. 13/221,519, filed Aug. 30, 2011, Pending.
U.S. Appl. No. 13/221,551, filed Aug. 30, 2011, Pending.
English Language Translation of JP 2002-525814 published Aug. 13, 2002.
English Language Abstract of JP 2006-156187 published Jun. 15, 2006.
English Language Translation of JP 2006-156187 published Jun. 15, 2006.
U.S. Appl. No. 13/044,369.
U.S. Appl. No. 12/888,921.
U.S. Appl. No. 13/034,959.
Related U.S. Appl. No. 12/794,379 electronically captured on May 16, 2012.
Related U.S. Appl. No. 12/794,429 electronically captured on May 16, 2012.
Related U.S. Appl. No. 12/794,476 electronically captured on May 16. 2012.
Related U.S. Appl. No. 12/794,509 electronically captured on May 16, 2012.
Related U.S. Appl. No. 12/811,795 electronically captured on May 16, 2012.
Related U.S. Appl. No. 12/738,081 electronically captured on May 16, 2012.
Related U.S. Appl. No. 12/713,230 electronically captured on May 16, 2012.
Related U.S. Appl. No. 12/845,330 electronically captured on May 16, 2012.
Related U.S. Appl. No. 12/885,005 electronically captured on May 16, 2012.
Related U.S. Appl. No. 12/933,969 electronically captured on May 16, 2012.
Related U.S. Appl. No. 12/886,123 electronically captured on May 16, 2012.
Related U.S. Appl. No. 13/044,369 electronically captured on May 16.2012.
Related U.S. Appl. No. 13/221,519 electronically captured on May 16, 2012.
Related U.S. Appl. No. 13/221,551 electronically captured on May 16, 2012.
Chinese Office Action issued in CN 201010216943 on Oct. 26, 2011.
English Language Translation of Chinese Office Action issued in CN 201010216943 on Oct. 26, 2011.
English Language Abstract of CN 101307887 published Nov. 19, 2008.
English Language Translation of JP 2009/117342 published May 28, 2009.
English Language Abstract of JP 2009/117342 published May 28, 2009.
English Language Abstract of JP 2004-119078 published Apr. 15, 2004.
English Language Translation of JP 2004-119078 published Apr. 15, 2004.
Related U.S. Appl. No. 12/794,379 electronically captured on Aug. 23, 2012.
Related U.S. Appl. No. 12/794,429 electronically captured on Aug. 23, 2012.
Related U.S. Appl. No. 12/794,476 electronically captured on Aug. 23, 2012.
Related U.S. Appl. No. 12/794,509 electronically captured on Aug. 23, 2012.
Related U.S. Appl. No. 12/811,795 electronically captured on Aug. 23, 2012.
Related U.S. Appl. No. 12/738,081 electronically captured on Aug. 23, 2012.
Related U.S. Appl. No. 12/713,230 electronically captured on Aug. 23, 2012.
Related U.S. Appl. No. 12/845,330 electronically captured on Aug. 23, 2012.
Related U.S. Appl. No. 12/885,005 electronically captured on Aug. 23, 2012.
Related U.S. Appl. No. 12/933,969 electronically captured on Aug. 23, 2012.
Related U.S. Appl. No. 12/886,123 electronically captured on Aug. 23, 2012.
Related U.S. Appl. No. 13/044,369 electronically captured on Aug. 23, 2012.

Related U.S. Appl. No. 13/221.519 electronically captured on Aug. 23, 2012.
Related U.S. Appl. No. 12/825,956 electronically captured on Aug. 23, 2012.
Related U.S. Appl. No. 12/885,849 electronically captured on Aug. 23, 2012.
Related U.S. Appl. No. 12/888,921 electronically captured on Aug. 23, 2012.
Chinese Office Action issued in CN 201010121809,11 on Mar. 31, 2012.
English Translation of Chinese Office Action issued in CN 201010121809.11 on Mar. 31, 2012.
English Language Abstract and Claims of CN20 149860 published Nov. 12, 2008.
English Language Abstract and Claims of CN201072113 published Jun. 11, 2008 English Language Abstract of CN2602514 published Feb. 4, 2004.
Extended European Search Report for EP 10179580.5, dated May 24, 2012.

* cited by examiner

SELF-BALLASTED LAMP AND LIGHTING EQUIPMENT

INCORPORATION BY REFERENCE

The present invention claims priority under 35 U.S.C. §119 to Japanese Patent Application Nos. 2009-221638 and 2009-227474 filed on Sep. 25, 2009 and Sep. 30, 2009, respectively. The contents of these applications are incorporated herein by reference in their entirety.

FIELD

Embodiments described herein relate generally to a self-ballasted lamp using semiconductor light-emitting elements, and lighting equipment using the self-ballasted lamp.

BACKGROUND

In a conventional self-ballasted lamp using LED chips as semiconductor light-emitting elements, a light-emitting module using the LED chips and a globe that covers the light-emitting module are attached to one end side of a metallic base body, a cap is attached to the other end side of the base body via an insulating member, and a lighting circuit is housed inside the insulating member.

When the self-ballasted lamp is turned on, heat generated by the LED chips is mainly conducted from a substrate to the base body and radiated into air from a surface of the base body which is exposed to the outside.

Additionally, as the light-emitting module, an SMD module mounting SMD (Surface Mount Device) packages with connection terminals, on which LED chips are loaded, on a substrate; a COB (Chip On Board) module in which a plurality of LED chips are closely arranged on a substrate; or the like are used.

The COB module has a single light-emitting portion provided and is capable of high-power light emission. However, since the plurality of LED chips are closely arranged in the light-emitting portion, the temperature of the LED chip easily rises. When the temperature of the LED chip rises excessively, the life of the LED chips is shortened and light output is reduced. Therefore, it is important to suppress a temperature rise of the LED chips by efficiently conducting heat generated by the LED chip to the base body and efficiently radiating the heat into air from the surface of the base body which is exposed to the outside.

Although, to efficiently radiate heat into air from the surface of the base body which is exposed to the outside, it is effective to increase the area of the surface of the base body which is exposed to the outside, and a problem arises that this leads to upsizing of the self-ballasted lamp and suitability of the lamp to lighting equipment using a general lighting lamp is reduced.

The present invention has been made in view of the above problems, and aims to provide a self-ballasted lamp which can secure sufficient radiation performance to suppress a temperature rise of a semiconductor light-emitting element without upsizing of the base body; and lighting equipment.

DETAILED DESCRIPTION

Figure 1:
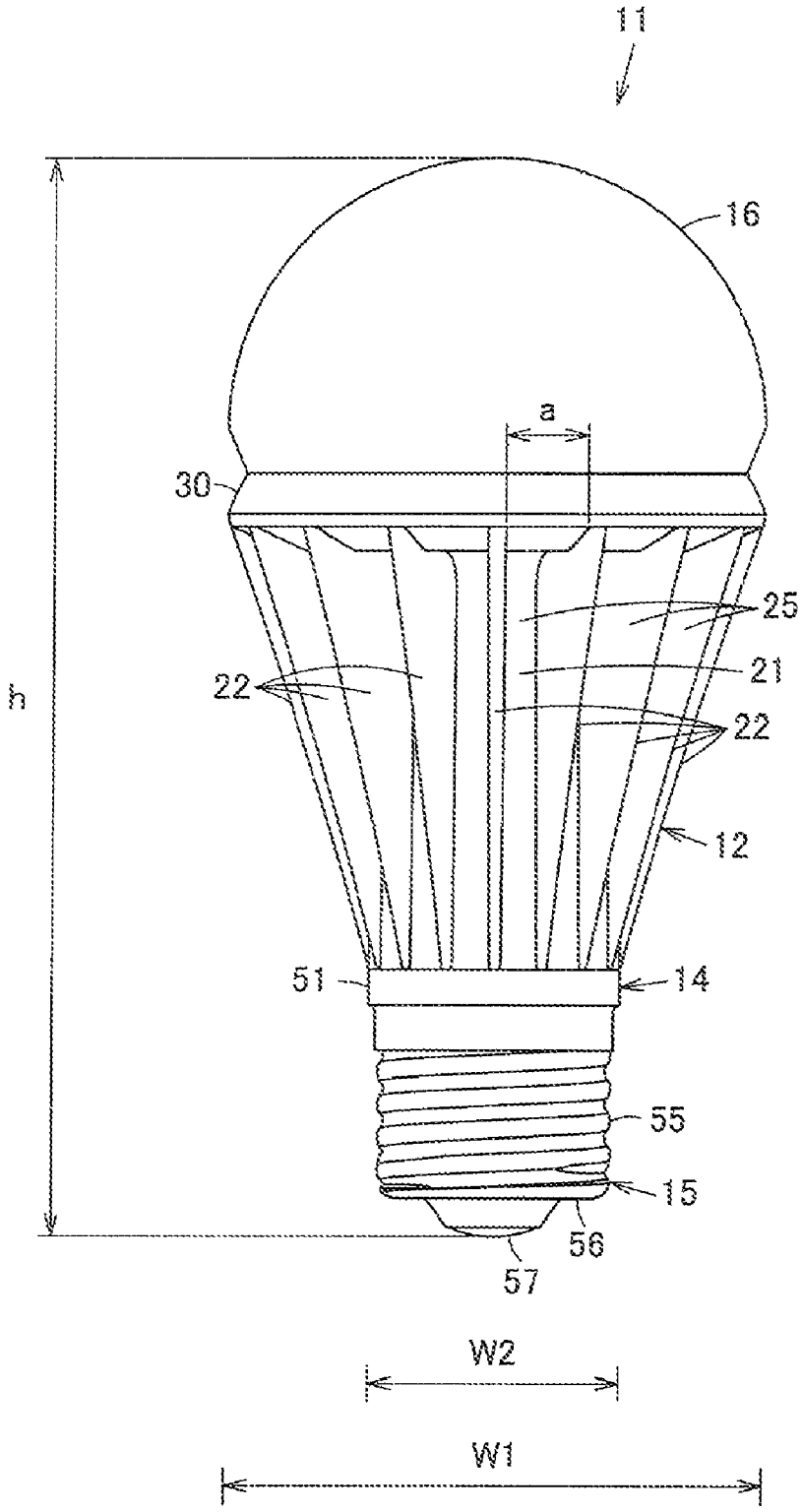
FIG. 1 is a side view of a self-ballasted lamp of Embodiment 1.
Figure 2:
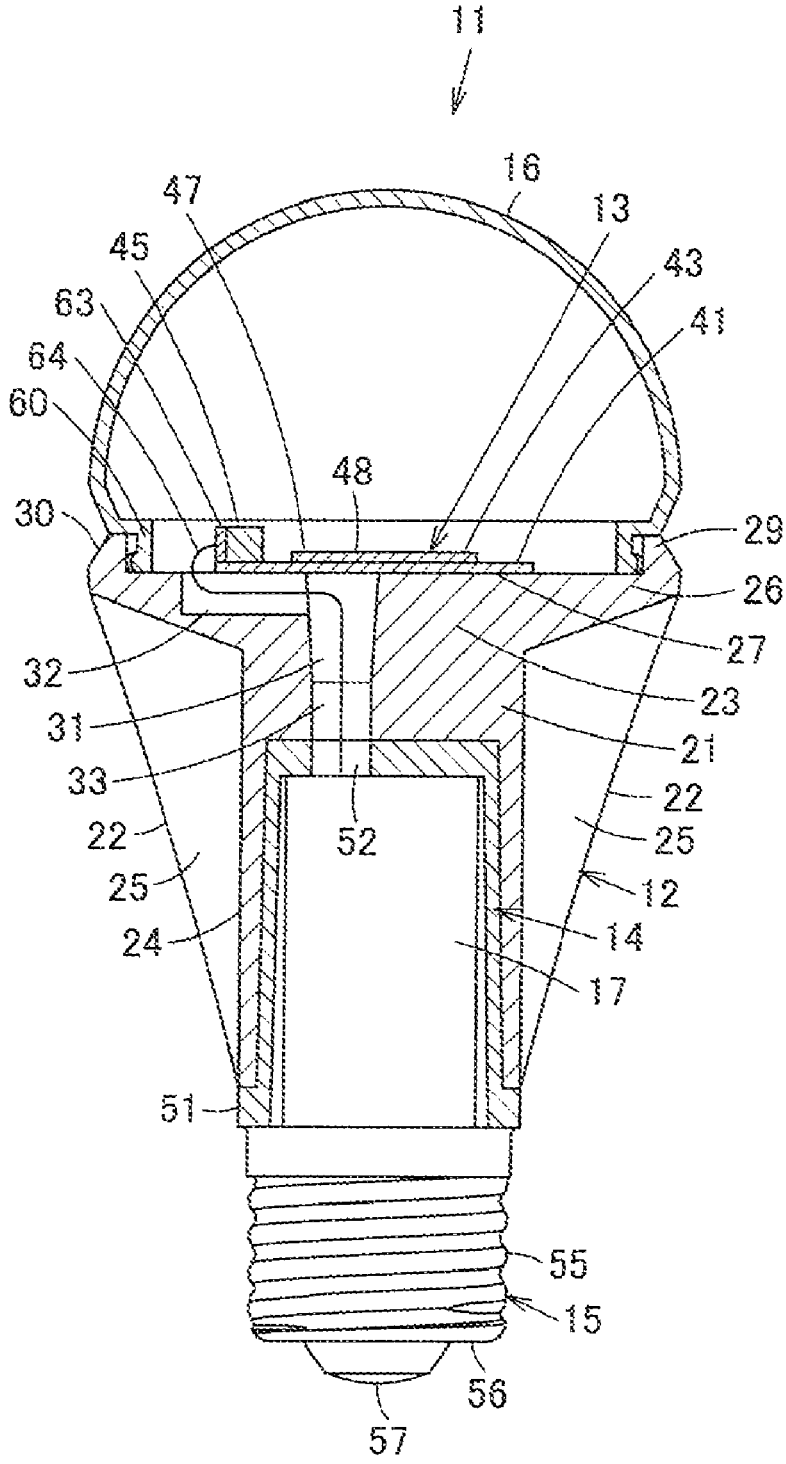
FIG. 2 is a cross sectional view of the self-ballasted lamp of Embodiment 1.
Figure 3:
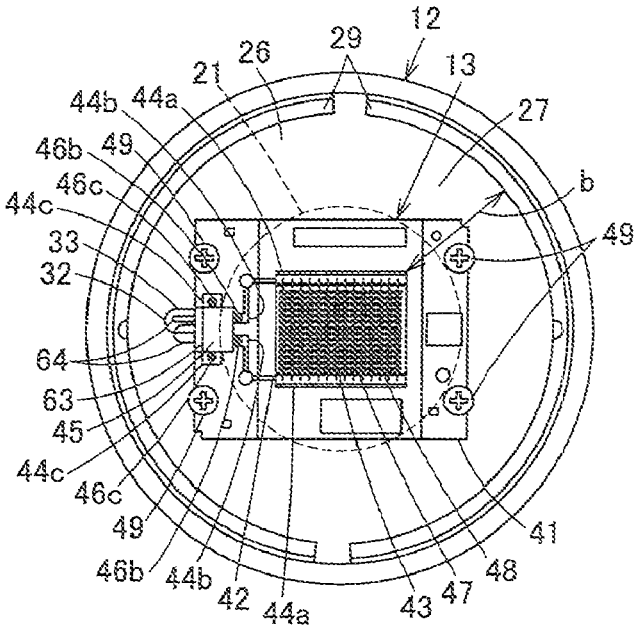
FIG. 3 is a front view of a base body and a light-emitting module of the self-ballasted lamp of Embodiment 1 which are viewed from one end side.
Figure 4:
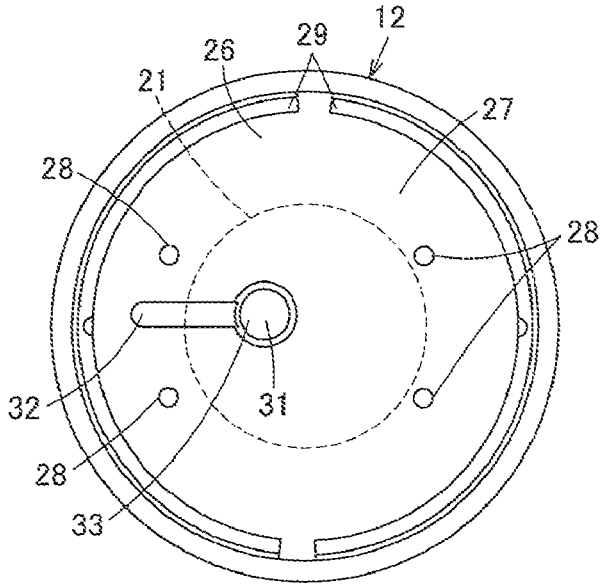
FIG. 4 is a front view of the base body of the self-ballasted lamp of Embodiment 1 which is viewed from one end side.

A self-ballasted lamp of the present embodiment includes a base body having a base body portion and a plurality of heat radiating fins provided on the circumference of the base body portion. A light-emitting module having semiconductor light-emitting elements and a globe that covers the light-emitting module are provided on one end side of the base body. A cap is provided on the other end side of the base body. A lighting circuit is housed between the base body and the cap. The lamp total length from the globe to the cap is 70 to 120 mm, the area of a surface of the base body which is exposed to the outside per 1 W of power charged to the light-emitting module is 20.5 to 24.9 $cm^2/W$.

Next, Embodiment 1 will be described with reference to FIGS. 1 to 6.

In FIGS. 1 to 9, the reference numeral 11 denotes a self-ballasted lamp. The self-ballasted lamp 11 includes: a metallic base body 12; a light-emitting module 13 attached to one end side (one end side in a lamp axial direction connecting a globe and cap of the self-ballasted lamp 11 to each other) of the base body 12; an insulating cover 14 attached to the other end side of the base body 12; a cap 15 attached to the other end side of the cover 14; a globe 16 which is attached to one end side of the base body 12 so as to cover the light-emitting module 13 and has light-transmissivity; and a lighting circuit 17 housed inside the cover 14 between the base body 12 and the cap 15.

The base body 12 is integrally formed of, for example, metal such as aluminum excellent in thermal conductivity, a base body portion 21 as a body portion is formed in a center region of the base body 12, and a plurality of heat radiating fins 22 are formed in the lamp axial direction on the circumference of the base body portion 21 so as to project radially around a lamp axis. Preferably, a surface of the substrate is subjected to alumite treatment.

On one end side of the base body portion 21, a columnar solid portion 23 is formed, and on the other end side thereof a cylindrical portion 24 opened toward the other end side is formed. A maximum diameter W1 of one end side of the base body portion 21 of the base body 12 is 55 to 65 mm, and a maximum diameter W2 of the other end side of the base body portion 21 is 25 to 30 mm.

The heat radiating fin 22 is obliquely formed so that the amount of projection of the fin 22 in a radial direction from the other end side to one end side of the base body 12 slowly increases. Additionally, the heat radiating fins 22 are radially formed in a circumferential direction of the base body 12 at approximately even intervals, and a gap 25 is formed between the heat radiating fins 22. The gaps 25 are opened toward the other end side and the periphery of the base body 12, and closed at one end side of the base body 12. An annular edge portion 26 continuing to the solid portion 23 is formed on the circumference of the solid portion 23 at one end side of the heat radiating fins 22 and gaps 25. Moreover, to improve radiation performance by the base body 12, a surface of the base body 12 is subjected to the alumite treatment.

An attachment face 27 with which and to which the light-emitting module 13 is brought into face-contact and attached is formed on a face of one end side of the base body 12, and a plurality of attachment holes 28, into which the light-emitting module 13 is screwed, is formed on the attachment face 27. On a circumferential region of one end side of the base body 12, an annular attachment portion 29 to which the globe 16 is attached is formed. An inclined face portion 30, of which one end side, the globe 16 side, has a small diameter, is formed at an outer circumference of the attachment portion 29.

On the base body portion 21 of the base body 12, a hole portion 31 for making the face of one end side of the base body 12 communicate with an inner face of the cylindrical portion 24, which constitutes the other end side of the base body 12, is formed at a position, which is located away from the center of the lamp axis in the lamp axial direction, a groove portion 32 is formed in the face of the one end side of the base body 12 so as to extend from one end side of the hole portion 31 to the circumferential region, and a wiring hole 33 is formed for connecting via wires the lighting circuit 17 to the light-emitting module 13 through the hole portion 31 and the groove portion 32.

When viewing the base body 12 from one end side thereof, the base body portion 21 has a volume more than that of the heat radiating fins 22, that is, a thermal capacity of the base body portion 21 capable of absorbing heat is more than that of the heat radiating fins 22.

The light-emitting module 13 has a quadrangular flat substrate 41 made of, for example, metal such as aluminum, or an insulating material such as ceramics or epoxy resin, a pair of wiring patterns 42 is formed on amounting face which is a face of one end side of the substrate 41, and a plurality of LED chips 43 as semiconductor light-emitting elements are closely arranged and mounted in a matrix on a center region of the mounting face. Moreover, in the case where the substrate 41 is made of metal, an insulating layer is formed on one face on which the LED chips 43 are mounted, and the wiring patterns 42 are formed on the insulating layer.

The light-emitting module 13 is a COB (Chip On Board) module, the mounting density of the LED chips 43 on the substrate 41 is 0.8 to 1.2 pcs/mm$^2$, and 50 to 200 LED chips 43 are mounted. When the mounting density of the LED chips 43 on the substrate 41 is less than 0.8 pcs/mm$^2$, this exceeds a limit of mounting precision of a machine which mounts the LED chips 43 on the substrate 41, heat is excessively concentrated and radiation performance deteriorates. When the mounting density is more than 1.2 pcs/mm$^2$, it is impossible to increase the density of close arrangement of the LED chips 43, to downsize a light-emitting portion 47 and obtain a sufficient distance between the light-emitting portion 47 and an inner face of the globe 16. Therefore, unevenness of brightness is caused to the globe 16 when the lamp is turned on, and when the lamp is turned off, color of the light-emitting portion 47 is reflected in the globe 16, and an uncomfortable feeling with a color different from the original color of the globe 16 is easily sensed. Accordingly, the mounting density of the LED chips 43 on the substrate 41 is preferably 0.8 to 1.2 pcs/mm$^2$. Additionally, when the number of LED chips 43 mounted is less than 50, necessary luminous flux is not obtained. On the other hand, when the number is more than 200, the light-emitting module 13 is upsized and the radiation performance of the LED chips 43 is lowered. Accordingly, 50 to 200 pieces of LED chips 43 are preferably mounted.

The pair of wiring patterns 42 forms a route for supplying power to the LED chips 43, a pair of electrode pads 44*a* for LED connection is formed at both sides of a mounting region of the LED chips 43, and the plurality of LED chips 43 are connected in series to the pair of electrode pads 44*a* by wire-bonding.

A connector 45 to be electrically connected to the wiring patterns 42 is disposed on an edge portion of the mounting face of the substrate 41 arranged on the grove portion 32 of the base body 12 with the light-emitting module 13 attached to the base body 12. Specifically, a pair of electrode pads 44*b* for connector connection is formed at ends of the pair of wiring patterns 42, and a pair of connector fixing pads 44*c*, which is electrically insulated from the wiring patterns 42, is formed at a position farther than the pair of electrode pads 44*b* from the LED chips 43. A pair of terminal portions for conduction (not shown), which is provided on a side face of the connector 45, is electrically connected to the pair of electrode pads 44*b* by solder 46*b*. Terminal portions for fixation (not shown), which are provided on both side faces of the connector 45, are fixed to the pair of connector fixing pads 44*c* by solder 46*c* respectively. The terminals for fixation do not electrically act on the connector 45, and mechanically support the connector 45.

As the LED chip 43, for example, an LED chip emitting blue light is used. A phosphor layer is formed so as to cover the plurality of LED chips 43 mounted on the substrate 41, the phosphor layer being obtained by mixing a yellow phosphor, which is excited by part of the blue light emitted from the LED chips 43 and radiates yellow light in, for example, transparent resin such as silicone resin. Thus, the light-emitting portion 47 is constituted by the LED chips 43 and the phosphor layer, a surface of the phosphor layer, which is a surface of the light-emitting portion 47, serves as a light-emitting face 48, and white-base light is radiated from the light-emitting face 48.

A plurality of insertion holes (not shown) are formed in the vicinity of four corners of the substrate 41, screws 49, which are inserted in the insertion holes respectively, are screwed into the attachment holes 28 of the base body 12 respectively, and thus a face of the other end side of the substrate 41 is brought into face-contact with and attached to the attachment face 27 which is the face of one end side of the base body portion 21 of the base body 12. Here, a thermally conductive material such as a sheet or grease excellent in thermal conductivity is interposed between the face of the other end side of the base body 41 and the attachment face 27 of the base body 12.

In a state where the substrate 41 is attached to the attachment face 27 of the base body 12, the center of the light-emitting face 48 of the light-emitting portion 47 is located on the center of the lamp axis and the light-emitting portion 47 of the light-emitting module 13 is located in a projection region (indicated by a dotted line in FIGS. 3 and 4), which is drawn on one end side of the base body 12, of the base body portion 21, in other words, the light-emitting portion 47 of the light-emitting module 13 is located in a region where the heat radiating fins 22 are not formed, so that the center of the light-emitting portion 47 of the light-emitting module 13 is arranged at a position farthest from the inner face of the globe 16. Moreover, it was confirmed that, as long as the substrate 41 is brought into face-contact with the attachment face 27 so that 90% or more, preferably 95% or more, of the light-emitting portion 47 exists in the projection region of the base body portion 21, heat is excellently conducted from the substrate 41 to the base body 12 and a desired heat radiation effect can be obtained. By setting a minimum distance b from the light-emitting portion 47 to an inner face of an opening edge portion of the globe 16 shown in FIG. 3 to 10 to 20 mm, preferably, 12 to 18 mm, reflection of the light-emitting portion 47 into the globe 16 can be reduced, luminance balance of the globe 16 during lighting of the light-emitting portion 47 can be improved and heat can be prevented from degrading the globe 16.

In the state where the substrate 41 is attached to the attachment face 27 of the base body 12, the edge portion, on which the connector 45 is mounted, of the substrate 41 is located on the wiring hole 33, an end portion of the groove portion 32 of the wiring hole 33 is exposed and opened without being covered with the substrate 41.

The cover 14 is formed of, for example, an insulating material such as PBT resin in a cylindrical shape opened toward the other end side. An annular flange portion 51, which is interposed between the base body 12 and the cap 15 and insulates them from each other, is formed in an outer circumferential portion of the other end side of the cover 14. A wiring hole 52 coaxially communicating with the wiring hole 33 of the base body 12 is formed in a face of one end side of the cover 14.

The cap 15 is, for example, an E26 type cap and connectable to a socket for general lighting lamps, and has a shell 55 which is engaged with, caulked by and fixed to the cover 14; an insulating portion 56 provided at the other end side of the shell 55; and an eyelet 57 provided at a top portion of the insulating portion 56.

The globe 16 is formed of glass, synthetic resin or the like having light diffuseness in a dome shape so as to cover the light-emitting module 13. The other end side of the globe 16 is opened, and an engaging portion 60, which is engaged with an inner circumferential side of the attachment portion 29 of the base body 12 and fixed thereto by adhesive, is formed on an edge portion of the opening of the other end side of the globe 16.

The lighting circuit 17 is, for example, a circuit for supplying constant current to the LED chips 43 of the light-emitting module 13 and has a circuit substrate on which a plurality of circuit elements constituting the circuit are mounted, and the circuit substrate is housed and fixed in the cover 14. The shell 55 and eyelet 57 of the cap 15 are electrically connected to an input side of the lighting circuit 17 by a connection wire. A connection wire 64 having a connector 63 at its top end is connected to an output side of the lighting circuit 17. The connector 63 and the connection wire 64 are pulled out to one end side of the base body 12 through the wiring hole 52 of the cover 14 and the wiring hole 33 of the base body 12, and the connector 63 is connected to the connector 45 on the substrate 41. Moreover, the lighting circuit 17 is connected to the light-emitting module 13 before the light-emitting module 13 is screwed in the base body 12.

In the self-ballasted lamp 11 thus constituted, a lamp total length h from the globe 16 to the cap 15 is 70 to 120 mm, preferably, 98 to 110 mm, in the same size range as that of a general lighting lamp of 40 to 100 W. In the embodiment, the length h is about 109 mm, the area of the surface of the base body 12 which is exposed to the outside per 1 W of power charged to the light-emitting module 13 is 20.5 to 24.4 $cm^2$/W. The area of the surface of the base body 12 which is exposed to the outside indicates the area of an outer peripheral face, which is not covered with the globe 16 and the cap 15, of the base body 12. In the embodiment, a power of 8.0 to 9.5 W is charged to the light-emitting module 13. An interval a between the heat radiating fins 22 is set to 7 to 10 mm.

Figure 6:
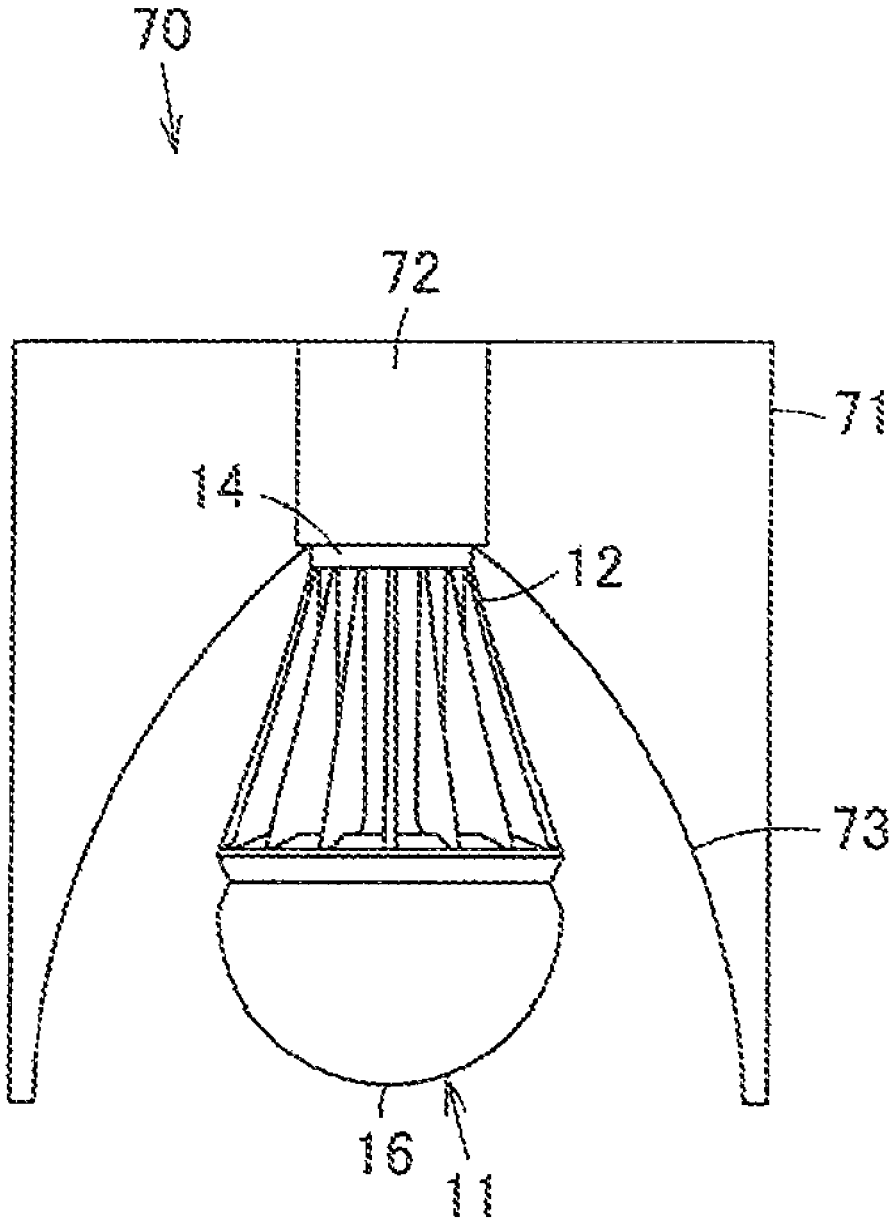
FIG. 6 is a cross sectional view of lighting equipment using the self-ballasted lamp of Embodiment 1.

FIG. 6 shows lighting equipment 70 which is a downlight using the self-ballasted lamp 11, the lighting equipment 70 has an equipment body 71 and a socket 72 and a reflection body 73 are disposed in the equipment body 71.

When the self-ballasted lamp 11 is energized by attaching the cap 15 to the socket 72 of the lighting equipment 70, the lighting circuit 17 operates, power is supplied to the plurality of LED chips 43 of the light-emitting module 13, the LED chips 43 emit light and the light is diffused and emitted through the globe 16.

Heat generated when the plurality of LED chips 43 of the light-emitting module 13 are turned on is conducted to the substrate 41 and further conducted from the substrate 41 to the base body 12, and efficiently radiated into air from a surface of the base body portion 21 which is exposed to the outside of the base body 12 and surfaces of the plurality of heat radiating fins 22.

Figure 5:
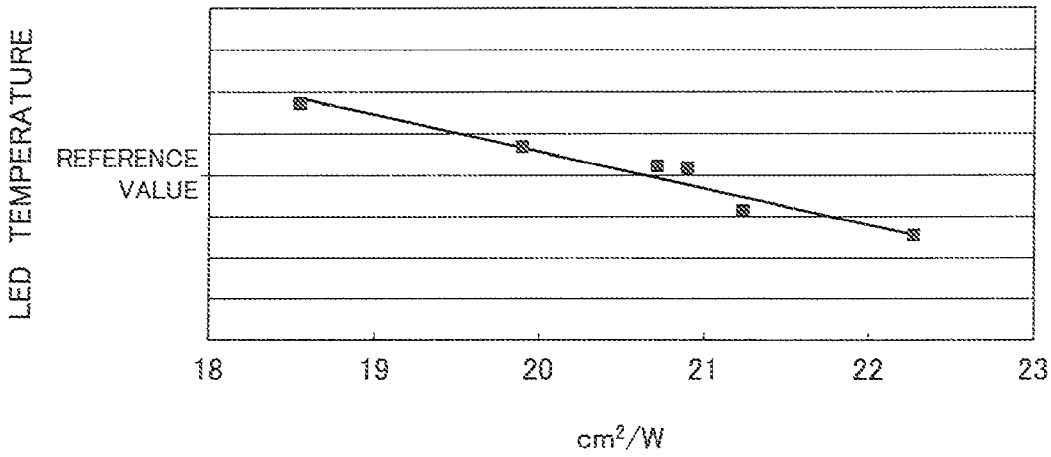
FIG. 5 is a graph indicating a relationship between the temperature of the LED chip of the self-ballasted lamp and the area of a surface of the base body which is exposed to the outside per 1 W of power charged to the light-emitting module of the self-ballasted lamp of Embodiment 1.

FIG. 5 shows a result of an experiment on a relationship between a junction temperature of the LED chip 43 and the area of the surface of the base body 12 which is exposed to the outside per 1 W of power charged to the light-emitting module 13. The junction temperature indicates, for example, temperature of a junction face between a P-type semiconductor and an N-type semiconductor which constitute the LED chip 43. A value of the junction temperature may be obtained by not directly measuring the temperature of the junction face but calculating by a computation expression based on the ambient temperature of the LED chip 43.

As shown in FIG. 5, when the area of the surface of the base body 12 which is exposed to the outside per 1 W of power charged to the light-emitting module 13 is less than 20.5 $cm^2$/W, sufficient radiation performance from the base body 12 to the air cannot be secured and the temperature of the LED chip 43 exceeds a predetermined reference value. The predetermined reference value is obtained from an experiment of measuring the life of the LED chip 43 according to its temperature, and it was confirmed that the life of the LED chip 43 is shortened when the temperature of the LED chip 43 exceeds the reference value, and can be lengthened by suppressing the temperature lower than the reference value. Thus, it is preferable for lengthening the life of the LED chip 43 to set the area of the surface of the base body 12 which is exposed to the outside per 1 W of power charged to the light-emitting module 13 to 20.5 $cm^2$/W or more.

On the other hand, generally, as the area of the surface of the base body 12 which is exposed to the outside per 1 W of power charged to the light-emitting module 13 becomes larger, the radiation performance is further increased. As a method for making the area of the surface of the base body 12 which is exposed to the outside large, it is considered that the gap 25 between the heat radiating fins 22 is narrowed and the number of heat radiating fins 22 is increased. However, when the gap 25 between the heat radiating fins 22 becomes too small, a convection current between heat radiating fins 22 is blocked and thus the radiation performance is lowered although the area of the surface of the base body 12 which is exposed to the outside is increased. Therefore, the area of the surface of the base body 12 which is exposed to the outside is required to increase without narrowing the gap 25 between the heat radiating fins 25 nor increasing the number of heat radiating fins 22. However, the substrate 12 is required to be upsized, the self-ballasted lamp 11 is upsized in accordance therewith, and suitability of the lamp 11 to the lighting equipment 70 for general lighting lamps is lowered. When only the surface area is made large without upsizing the substrate 12, for example, a substrate 12 can be manufactured, in which the area of the surface of the base body 12 which is exposed to the outside per 1 W of power charged to the light-emitting module 13 exceeds 24.4 $cm^2/W$, by increasing the number of heat radiating fins 22. However, this case is undesirable, because a large number of portions, each of which has a thickness less than 1.0 mm, of the heat radiating fin 22 are generated and thermal conductivity of the heat radiating fin 22 is lowered. Therefore, in order to increase the area of a surface of the base body 12 which is exposed to the outside, when an experiment was performed to obtain an area of the surface of the base body 12 which is exposed to the outside so that sufficient suitability of the self-ballasted lamp 11 to the lighting equipment 70 for general lighting lamps can be obtained without making the substrate 12 too large, it was confirmed that the area of the surface of the base body 12 which is exposed to the outside per 1 W of power charged to the light-emitting module 13 is preferably 24.4 $cm^2/W$ or less.

Accordingly, when the area of the surface of the base body 12 which is exposed to the outside per 1 W of power charged to the light-emitting module 13 is 20.5 to 24.4 $cm^2/W$, sufficient radiation performance can be secured, and the size of the substrate 12 does not become too large and is set in an optimum range.

As described above, according to the self-ballasted lamp 11 of the present embodiment, since the lamp total length h from the globe 16 to the cap 15 is 70 to 120 mm and the area of the surface of the base body 12 which is exposed to the outside per 1 W of power charged to the light-emitting module 13 is 20.5 to 24.4 $cm^2/W$, sufficient radiation performance can be secured by making the area of the surface of the base body 12 which is exposed to the outside large, and an optimum range that the size of the base body 12 is not made too large can be regulated. That is, the base body 12 is not upsized and sufficient radiation performance for suppressing a temperature rise of the LED chip 43 can be secured.

When an experiment was performed to confirm a relationship between the gap 25 between the heat radiating fins 22 and the radiation performance, it was confirmed that, when the gap 25 between the heat radiating fins 22 is less than 7 mm, the convection current between the heat radiating fins 22 is blocked and the radiation performance is lowered although the surface area of the base body 12 is increased. On the other hand, when the gap 25 between the heat radiating fins 22 is more than 10 mm, the base body 12 is required to be upsized in order to secure a necessary surface area of the base body 12. Accordingly, 7 to 10 mm of the gap 25 between the heat radiating fins 22 is an optimum range that the convection current between the heat radiating fins 22 is not blocked and the area of the surface of the base body 12 which is exposed to the outside can be made large.

Since the light-emitting portion 97 of the light-emitting module 13 is arranged at a position farthest from the inner face of the globe 16, the light-emitting portion 47 is arranged at the center of one end side of the base body 12 and thermal conductivity from the light-emitting portion 47 to the base body 12 is increased, and the radiation performance can be improved. Additionally, compared with the case where the light-emitting portion 47 is arranged at a position deviating from the center of one end side of the base body 12, the unevenness of brightness of the globe 16 can be prevented when the lamp is turned on, and, when the lamp is turned off, an uncomfortable feeling with a color different from the original milky-white color of the globe 16 can be lowered, the uncomfortable feeling being caused in a manner that the color of the phosphor included in the light-emitting portion 47 is reflected in the globe 16.

When viewing the base body 12 from one end side, the base body portion 21 has a volume more than that of the heat radiating fins 22, that is, the thermal capacity of the base body portion 21 capable of absorbing heat is more than that of the heat radiating fins 22. Therefore, when the light-emitting portion 47 of the light-emitting module 13 is positioned in a region of one end side, preferably within the region of the base body portion 21, heat generated from the plurality of LED chips 43 can be efficiently and continuously absorbed by the base body portion 21 having a large thermal capacity. Thus, heat can be efficiently conducted to the base body portion 21 of the base body 12, thermal conductivity from the base body portion 21 to the heat radiating fins 22 is made excellent, the heat can be efficiently radiated by the heat radiating fins 22 to the outside, and the temperature rise of the LED chip 43 can be effectively suppressed.

Since the wiring hole 33 is formed by the hole portion 31 for making one end side and the other end side of the base body portion 21 of the base body 12 communicate with each other; and the groove portion 32 formed in the face of one end side of the base body 12 so as to extend from one end side of the hole portion 31 to the circumferential region of the base body 12, wiring connection between the lighting circuit 17 and the light-emitting module 13 can be easily performed while thermal conductivity from the light-emitting module 13 to the base body 12 is secured.

In particular, since the hole portion 31 of the wiring hole 33 is formed at a position deviating from the center of the base body portion 21, the heat generated from the LED chips 43 can be efficiently conducted to the center of the base body portion 21 even if the LED chips 43 of the light-emitting module 13 are arranged at a position corresponding to the center of the base body portion 21 in consideration of light distribution of the self-ballasted lamp 11.

The connector fixing pads **44*c* are formed at a position farther than the electrode pads 44*b* from the LED chips 93 on the substrate 91 of the light-emitting module 13, the terminal portions of the connector 45 are connected to the electrode pads 44*b* by the solder 46*b* respectively, and the terminal portions for fixation of the connector 95 are fixed to the connector fixing pads 44*c* by the solder 46*c* respectively. Thus, the solder 46*b* connecting the terminal portions of the connector 45 to the electrode pads 44*b* is more easily affected by the heat generated from the LED chips 43, compared with the solder 46*c* adhering the terminal portions for fixation of the connector 45 to the connector fixing pads 44*c*. Accordingly, when the LED chip 43 has trouble due to some cause and abnormally heats, the solder 46*b* connecting the terminal portions of the connector 45 to the electrode pads 44*b* melts sooner than the solder 46*c* fixing the terminal portions for fixation of the connector 45 to the connector fixing pads 44*c*, and the connector 45** is easily electrically opened.

Particularly, as described in the above embodiment, in a case where a great number of LED chips 43 are mounted and concentrated at high density, heat diffusion from the LED chip 43 has a direction from the light-emitting portion 47 to an outer periphery of the substrate 41, compared with a case where a plurality of SMD packages are dispersed and arranged on a substrate. Accordingly, influence of the heat from the LED chips 43 tends to depend on the positional relationship between the electrode pads **44*b* and the connector fixing pads 44*c***, and there is an advantage of being excellent in reproducibility of the above phenomenon.

When the connector 45 is electrically opened, energization to the LED chip 43 is blocked, the temperature of the LED chip 43 is lowered, melting of the solder **46*c* of the terminal portions for fixation of the connector 45 is reduced, and fixation of the connector 45 to the substrate 41 is difficult to lose. Consequently, even when the light-emitting module 13** drops off from the base body 12 due to some cause, dropping or detachment of the light-emitting module 13 can be reduced by the connection wire 64 via the connector 45. Even when the connection wire 64 has a surplus in length or fixation of the solder 46*c* to the terminal portions for fixation of the connector 45 is lost, it can be expected that electrical conduction to the light-emitting module 13 is blocked in advance. Thus, occurrence of trouble by detachment of the light-emitting module 13 can be reduced.

Figure 7:
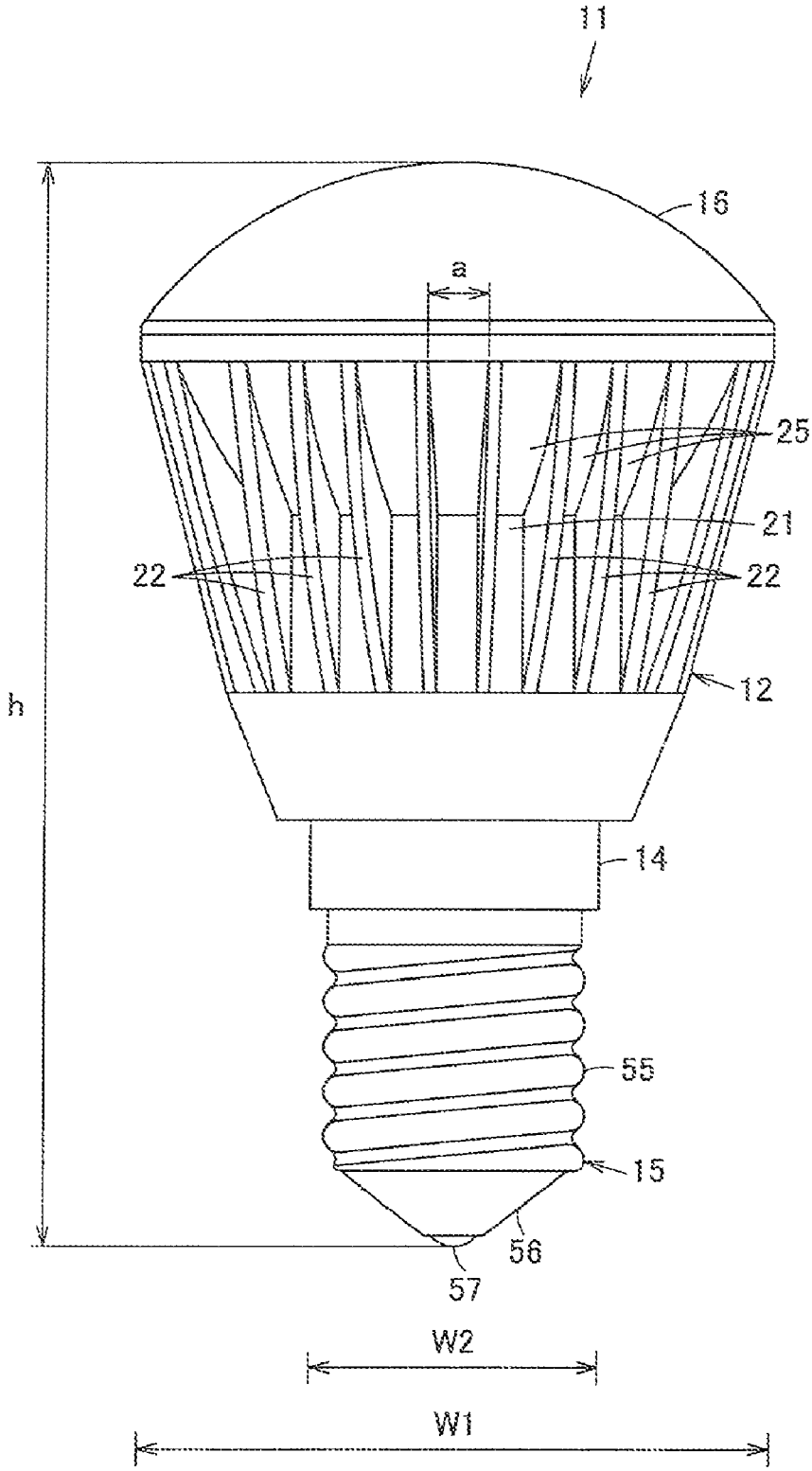
FIG. 7 is a side view of a self-ballasted lamp of Embodiment 2.

Next, Embodiment 2 is described with reference to FIG. 7. In addition, the same symbols are attached to the same components as those of Embodiment 1, and description thereof is omitted.

A self-ballasted lamp 11 of Embodiment 2 is a mini-krypton bulb type using an E17 type cap, although the self-ballasted lamp 11 of Embodiment 1 is an incandescent bulb type using the E26 type cap. The self-ballasted lamp 11 of Embodiment 2 has the same basic structure and layout as those of the self-ballasted lamp 11 of Embodiment 1.

The self-ballasted lamp 11 has a lamp total length h from a globe 16 to a cap 15 of approximately 72 mm, a maximum diameter W1 of one end side of a base body portion 21 of 42 to 45 mm, a maximum diameter. W2 of the other end side of the base body portion 21 of 15 to 20 mm, an interval a between heat radiating fins 22 of 7 to 10 mm, and a power charged to a light-emitting module 13 of 2.2 to 2.8 W. Also, in the case of the self-ballasted lamp 11, the area of a surface of the base body 12 which is exposed to the outside per 1 W of power charged to the light-emitting module 13 is 20.5 to 24.4 $cm^2$/W.

Even in the mini-krypton bulb type self-ballasted lamp 11 thus using the E17 type cap, since the area of the surface of the base body 12 which is exposed to the outside per 1 W of power charged to the light-emitting module 13 is 20.5 to 24.4 $cm^2$/W, sufficient radiation performance can be secured by making the area of the surface of the base body 12 which is exposed to the outside large, and the size of the base body 12 is not made too large and can be regulated within an optimum range. That is, the base body 12 is not upsized and radiation performance sufficient to suppress a temperature rise of the LED chip 43 can be secured.

Moreover, as the semiconductor light-emitting element, an EL (Electro Luminescence) element may be used in addition to the LED chip 43.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A self-ballasted lamp comprising:

a light-emitting module having a light-emitting portion in which a plurality of semiconductor light-emitting elements are mounted on one face of a substrate;

a base body which has a base body portion and a plurality of heat radiating fins provided on the circumference of the base body portion and that the light-emitting module is thermally-conductively brought into contact with one end side of the base body portion;

a globe which is provided on one end side of the base body so as to cover the light-emitting module;

a cap provided on the other end side of the base body; and a lighting circuit housed between the base body and the cap, wherein the lamp total length from the globe to the cap is 70 to 120 mm, and the area of a surface the base body which is exposed to the outside per 1 W of power charged to the light-emitting module is 20.5 to 24.4 $cm^2$/W.

2. The self-ballasted lamp according to claim 1, wherein the plurality of heat radiating fins extend along a center axis of the base body and are radially formed outward from the center axis of the base body, and the interval between the heat radiating fins is 7 to 10 mm.

3. The self-ballasted lamp according to claim 1, wherein the light-emitting module is arranged at a position where the center of the light-emitting portion is farthest from an inner face of the globe.

4. The self-ballasted lamp according to claim 1, wherein, on one face of the substrate of the light-emitting module, wiring patterns constituting a route for supplying power to the semiconductor light-emitting elements; electrode pads for connectors electrically connected to the wiring patterns; and connector fixing pads which are arranged farther than the electrode pads from the semiconductor light-emitting elements and electrically insulated from the semiconductor light-emitting element are formed, and a connector is mounted which has terminal portions soldered and conducted to the electrode pads and terminal portions for fixation soldered to the connector fixing pads, and is connected to the lighting circuit via wires.

5. Lighting equipment comprising:

an equipment body having a socket; and the self-ballasted lamp according to claim 1 attached to the socket of the equipment body.

6. A self-ballasted lamp comprising:

a light-emitting module having a light-emitting portion in which a plurality of semiconductor light-emitting elements are mounted on one face of a substrate;

a base body which has a base body portion and a plurality of heat radiating fins and that the light-emitting module is thermally-conductively brought into contact with one end side of the base body portion:

a globe which is provided on one end side of the base body so as to cover the light- emitting module;

a cap provided on the other end side of the base body; and a lighting circuit housed between the base body and the cap, wherein in the base body, a solid portion is formed on one end side of the base body portion, and a plurality of heat radiating fins are formed integrally on a circumference of the base body portion including the solid portion.

the light-emitting portion of the light-emitting module is positioned within a region of one end side of the base body portion, and the lamp total length from the globe to the cap is 70 to 120mm, and the area of a surface the base body which is exposed to the outside per 1 W of power charged to the light-emitting module is 20.5 to 24.4 $cm^2$/W.

7. The self-ballasted lamp according to claim 6, wherein the plurality of heat radiating fins extend along a center axis of the base body and are radially formed outward from the center axis of the base body, and the interval between the heat radiating fins is 7 to 10mm.

8. The self-ballasted lamp according to claim 6, wherein the light-emitting module is arranged at a position where the center of the light-emitting portion is farthest from an inner face of the globe.

9. The self-ballasted lamp according to claim 6, wherein, on one face of the substrate of the light-emitting module, wiring patterns constituting a route for supplying power to the semiconductor light-emitting elements; electrode pads for connectors electrically connected to the wiring patterns; and connector fixing pads which are arranged farther than the electrode pads from the semiconductor light-emitting elements and electrically insulated from the semiconductor light-emitting element are formed, and a connector is mounted which has terminal portions soldered and conducted to the electrode pads and terminal portions for fixation soldered to the connector fixing pads, and is connected to the lighting circuit via wires.

10. Lighting equipment comprising:

an equipment body having a socket; and the self-ballasted lamp according to claim 6 attached to the socket of the equipment body.

* * * * *